US007249967B2

(12) United States Patent
Tseng

(10) Patent No.: US 7,249,967 B2
(45) Date of Patent: Jul. 31, 2007

(54) ATTACHMENT FOR A LIGHT STRING

(76) Inventor: Wei-Jen Tseng, 5F, No. 10, Lane 23, Tungshan St., Hsinchu (TW)

( * ) Notice: Subject to any disclaimer, the term of this patent is extended or adjusted under 35 U.S.C. 154(b) by 117 days.

(21) Appl. No.: 10/907,460

(22) Filed: Apr. 1, 2005

(65) Prior Publication Data

US 2006/0221645 A1 Oct. 5, 2006

(51) Int. Cl.
*H01R 13/60* (2006.01)

(52) U.S. Cl. ..... 439/575; 362/249

(58) Field of Classification Search ..... 439/576, 439/575, 602; 362/249, 387, 258, 252
See application file for complete search history.

(56) References Cited

U.S. PATENT DOCUMENTS 4,970,632 A * 11/1990 Tseng ..... 362/654
6,179,647 B1 * 1/2001 Kinderman ..... 439/470
6,315,430 B1 * 11/2001 Huang ..... 362/249
6,672,897 B2 * 1/2004 Tseng ..... 439/505
2006/0270282 A1 * 11/2006 Tsai ..... 439/666

* cited by examiner

*Primary Examiner*—Tulsidas C. Patel
*Assistant Examiner*—Phuongchi Nguyen
(74) *Attorney, Agent, or Firm*—Alan Kamrath; Kamrath & Associates P.A.

(57) ABSTRACT

An attachment for a light string having sockets for respectively receiving therein bulb assemblies and wires extending out of the sockets includes a body. The body of the attachment has a through hole defined through the body and a fastener slot defined in the body. A cord is able to extend into the through hole and is fastened in the fastener slot. The cord is held securely in the body of the attachment of each socket so when a force acts on the Christmas light string, the Christmas light string has enough strength not to break.

5 Claims, 10 Drawing Sheets

ATTACHMENT FOR A LIGHT STRING

BACKGROUND OF THE INVENTION

1. Field of the Invention

The present invention relates to a light string and, more particularly, to a light string having an attachment with which a cord of the light string is securely affixed to the light socket.

2. Description of Related Art

Throughout the world, festivals are celebrated in particular with light strings because of the attractive sparkling emitted by the light strings. Christmas is especially associated such light strings, and Christmas light strings are referred to hereinafter though it is to be appreciated that the invention applies to any such light string for use on any appropriate occasion.

Christmas lights comprise multiple sockets and multiple bulb assemblies, respectively, having at least two electric wires. The bulb assemblies are separately installed into each socket. The wires connect each socket to one another.

Most installations of Christmas lights are hung or the wires are entwined to an object, such as a tree. Sometimes, a force will act on the wires and may cause them to break. Thus, manufacturers of Christmas light will entwine at least one extra wire to the Christmas lights to add strength to the Christmas light string. Two ends of the extra wire are separately secured to two ends of the Christmas light string. However, the ends of the extra wire will get loose from the ends of the Christmas light string after a period of use so the extra wire becomes ineffective when the force acts on the Christmas light string. The Christmas light string is easily broken once the reinforcement of the extra wire is lost.

To overcome the shortcomings, the present invention provides an attachment for a light string to obviate or mitigate the aforementioned problems.

SUMMARY OF THE INVENTION

The primary objective of the present invention is to provide an attachment for a light string that is able to fasten a cord without letting the cord eventually become loose.

The attachment for a light string having sockets for respectively receiving therein bulb assemblies and wires extending out of the sockets includes a body. The body of the attachment has a through hole defined through the body and a fastener slot defined in the body. An end of the cord is able to extend into the through hole and fasten into the fastener slot. The end of the cord is not able to get loose from the attachment, so another end of the cord is also able to fasten to another socket with the attachment. Thus, a Christmas light string has the cord secured on the attachment such that when a force acts on the Christmas light string, it has enough strength to resist the force.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
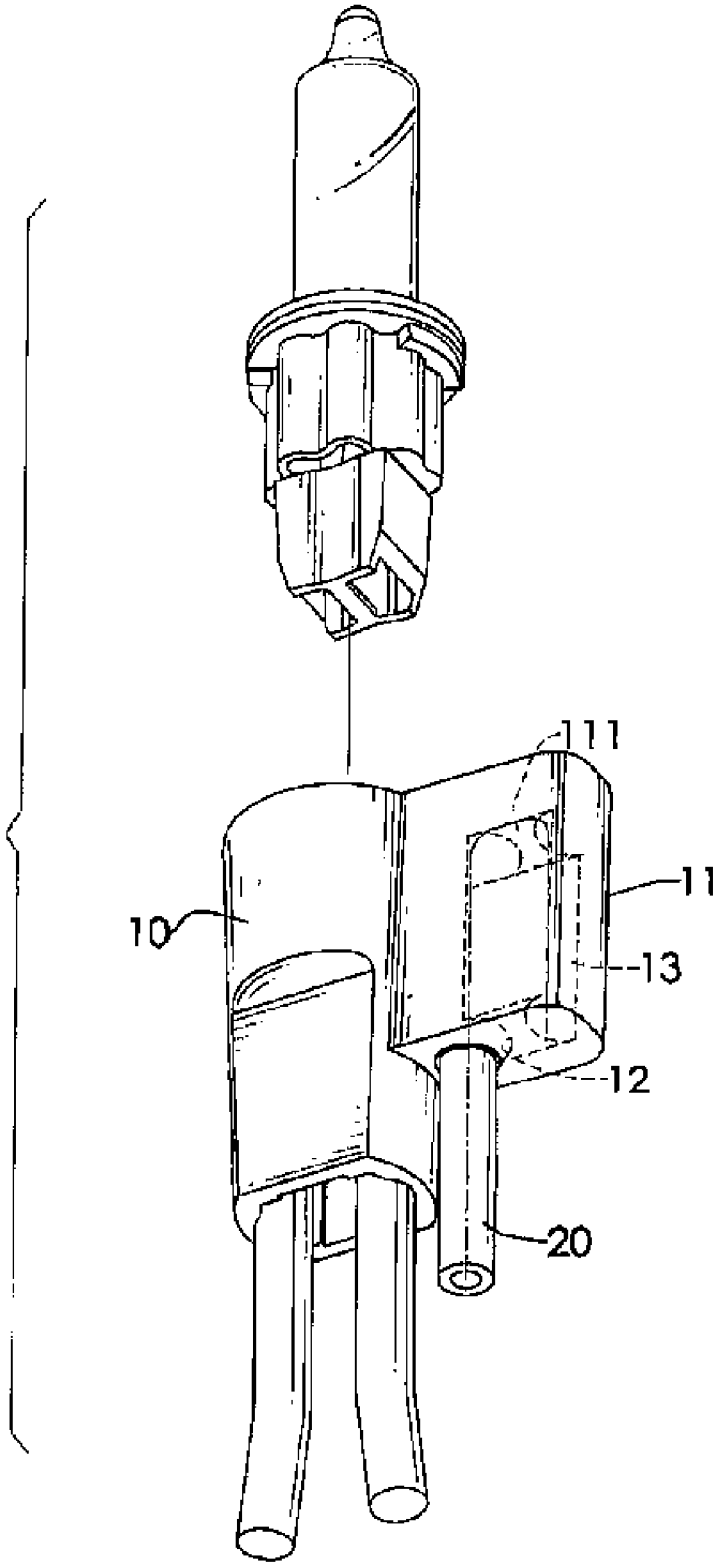
FIG. 1 is a perspective view of a first embodiment of an attachment for a light string in accordance with the present invention.

With reference to FIGS. 1, 2, 5, 6, 8, 11 and 15, an attachment (11, 11A, 11B, 11C) for a light string has sockets (10) for respectively receiving therein bulb assemblies (30) and cords (20) extending out of a corresponding one of the sockets (10). The attachment (11, 11A, 11B, 11C) is adapted to be securely attached to a side of the socket (10) and includes a body.

The socket (10) has a top opening, two sides, and an optional recess. The recess of the socket (10) receives an insert of the bulb assembly (30). The bulb assembly (30) has at least two sides.

With further reference to FIG. 1, a first embodiment of the attachment for a light string in accordance with the present invention is shown. The body of the attachment (11) has a through hole (12), a fastener slot (13), a block (111), a top edge and multiple sides. The through hole (12) is formed through the body and near the socket (10). The fastener slot (13) is formed inside of the body. The block (111) is located inside of the body and between the through hole (12) and fastener slot (13). An end of a cord (20) extends into the through hole (12) and is received in the fastener slot (13) to fasten the end of the cord (20) to the body of the attachment (11).

Figure 2:
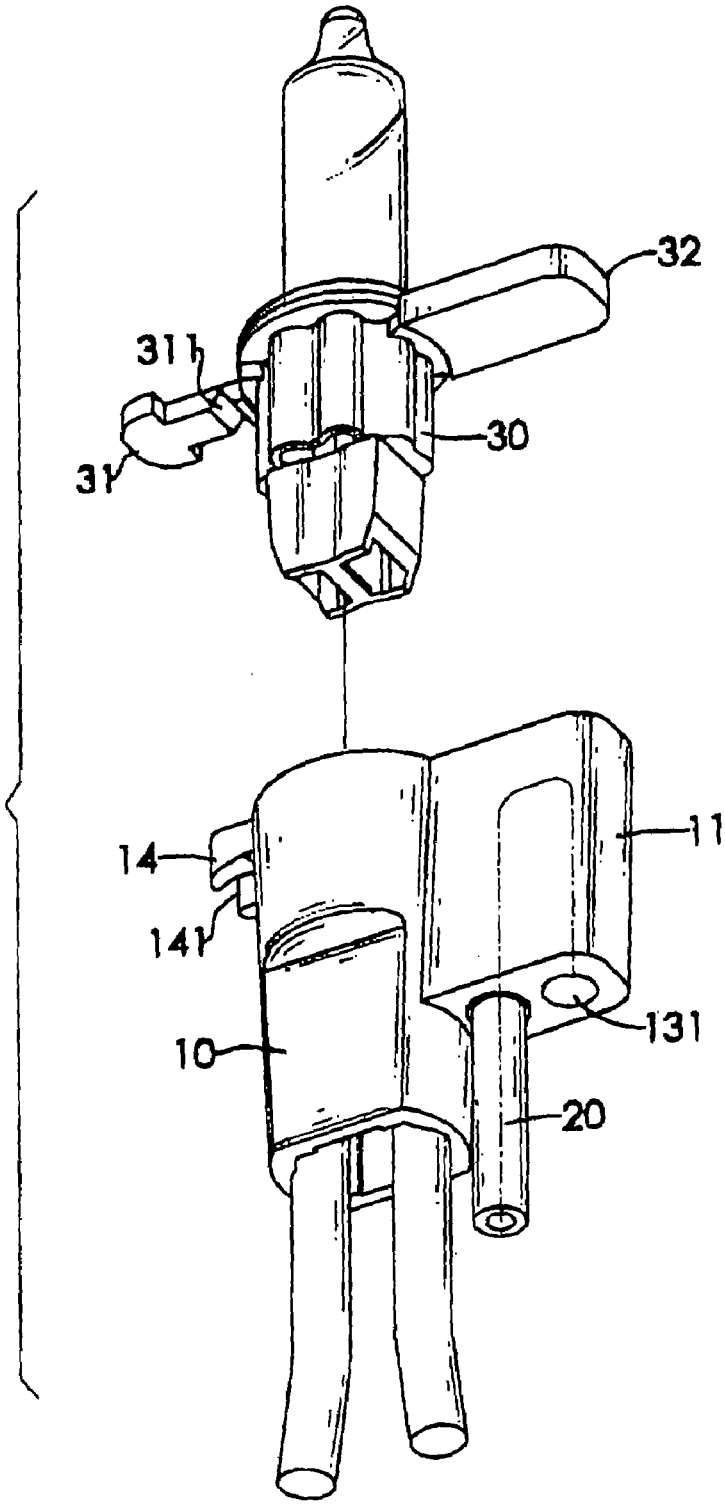
FIG. 2 is an exploded perspective view of a second embodiment of the attachment for a light string in accordance with the present invention.
Figure 3:
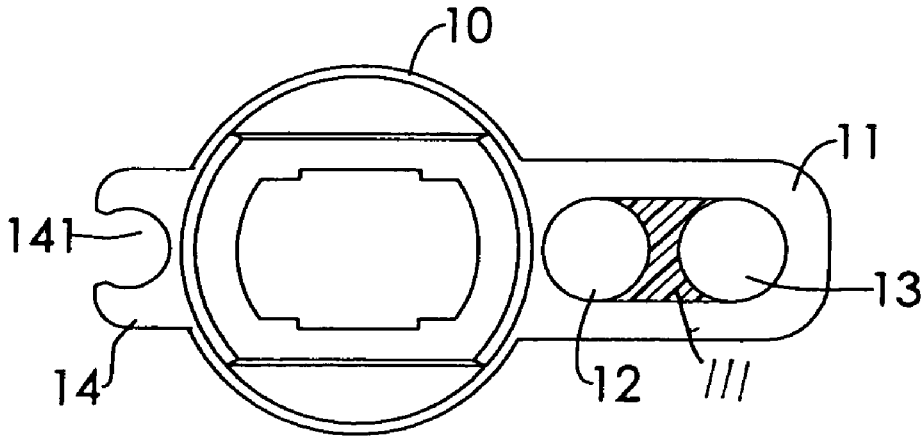
FIG. 3 is a top view of the attachment for a light string in FIG. 2.
Figure 4:
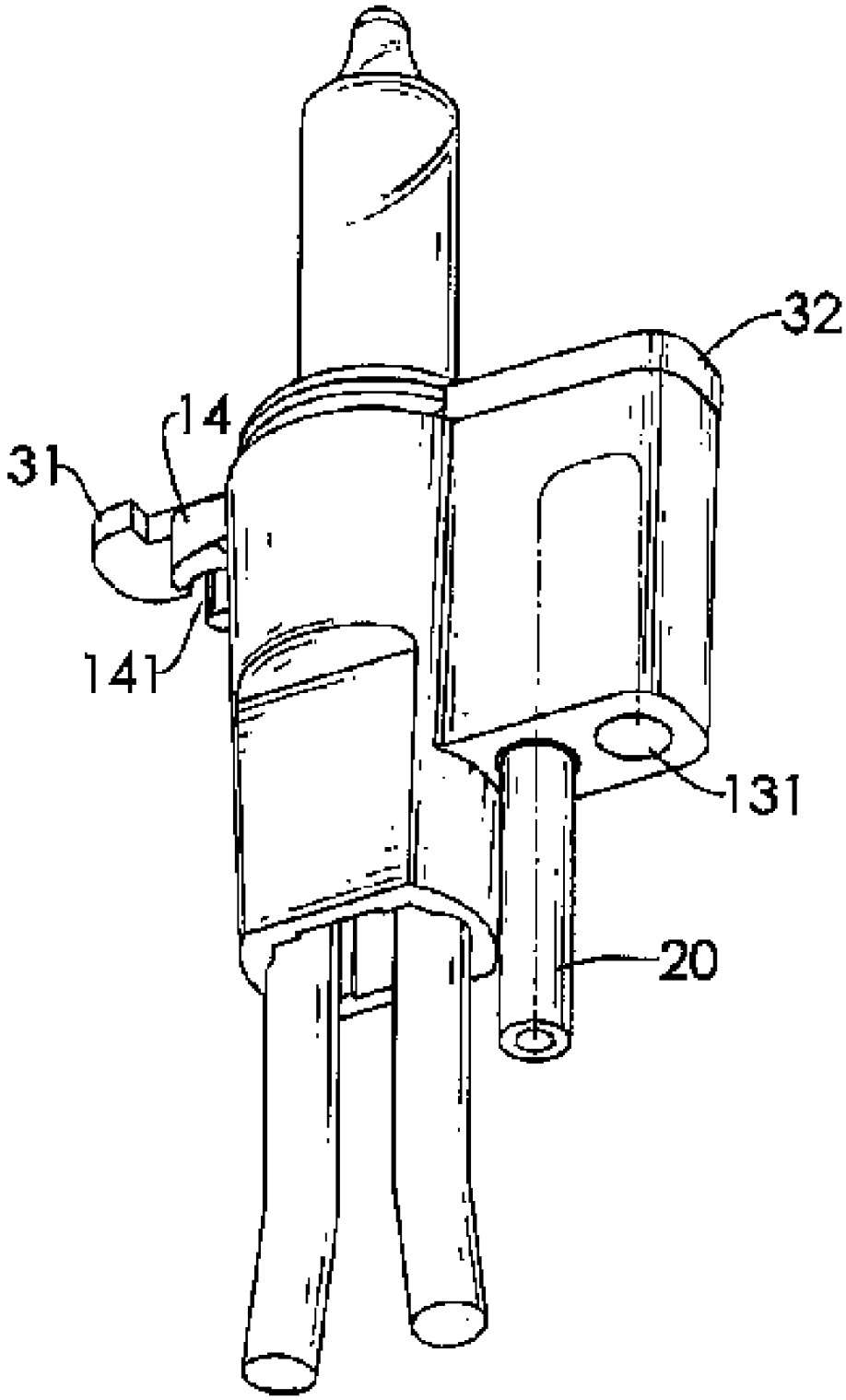
FIG. 4 is a perspective view of the attachment for a light string in FIG. 2 with a bulb assembly inserted into a socket.

With reference to FIGS. 2, 3 and 4, a second embodiment of an attachment for a light string in accordance with the present invention is shown. The socket (10) further has two optional protrusions (14) and an optional compartment (141)

defined between the two protrusions (14). The two protrusions (14) extend out of the socket (10) and are opposite to the attachment (11).

The fastener slot (13) of the body of the attachment (11) further has a bottom and an optional passage (131) which is defined through the bottom of the fastener slot (13) and allows the end of the cord (20) in the fastener hole (13) to extend out of the body of the attachment (11).

The bulb assembly (30) further has an optional T-shaped tongue (31) and an optional cap (32). The T-shaped tongue (31) extends out of the side of the bulb assembly (30) and has a joint and a notch (311) defined at the joint between the T-shaped tongue (31) and the bulb assembly (30) to facilitate pivotal movement of the T-shaped tongue (31).

The cap (32) extends out and is opposite to the T-shaped tongue (31). The cap (32) is attached to the top edge of the body of the attachment (11) and is able to cover the through hole (12) and the fastener slot (13) so as to prevent the free end of the cord (20) from becoming loose inside the body of the attachment (11). In an alternative embodiment, the cap (32) is a separate element from the other element and is attached to the top edge of the body of the attachment (11) to cover the through hole (12) and the fastener slot (13).

Figure 5:
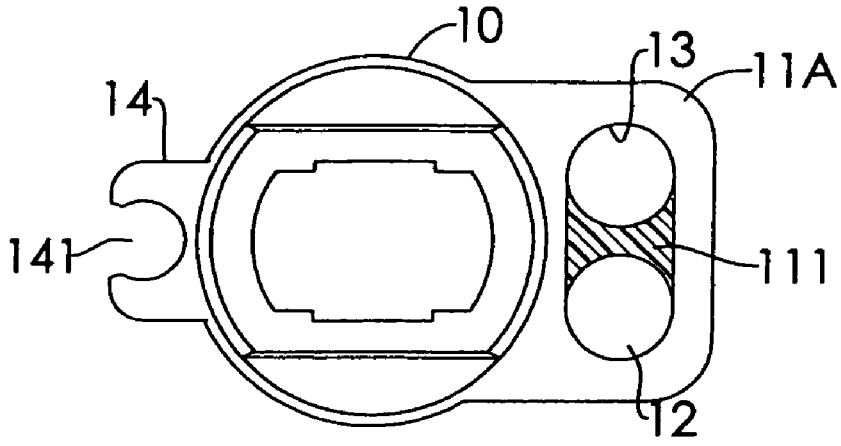
FIG. 5 is a top view of a third embodiment of the attachment for a light string in accordance with the present invention.

With reference to FIG. 5, a third embodiment of an attachment for a light string in accordance with the present invention is shown. The through hole (12) and the fastener slot (13) are both defined in the body of the attachment (11A) and located next to each other.

Figure 6:
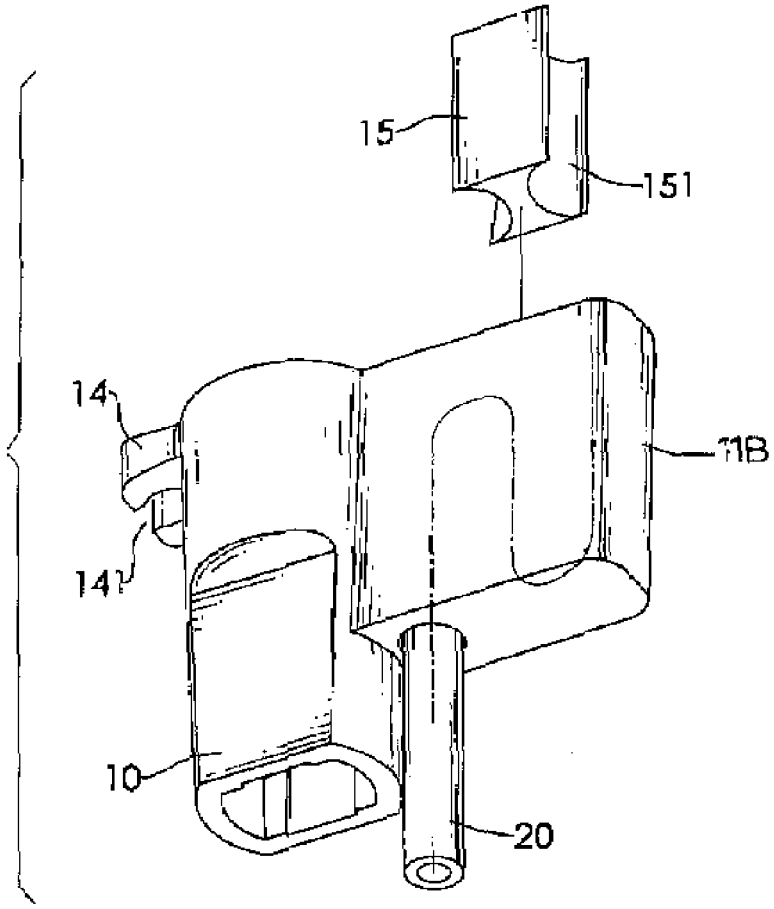
FIG. 6 is an exploded perspective view of a fourth embodiment of the attachment for a light string in accordance with the present invention.
Figure 7:
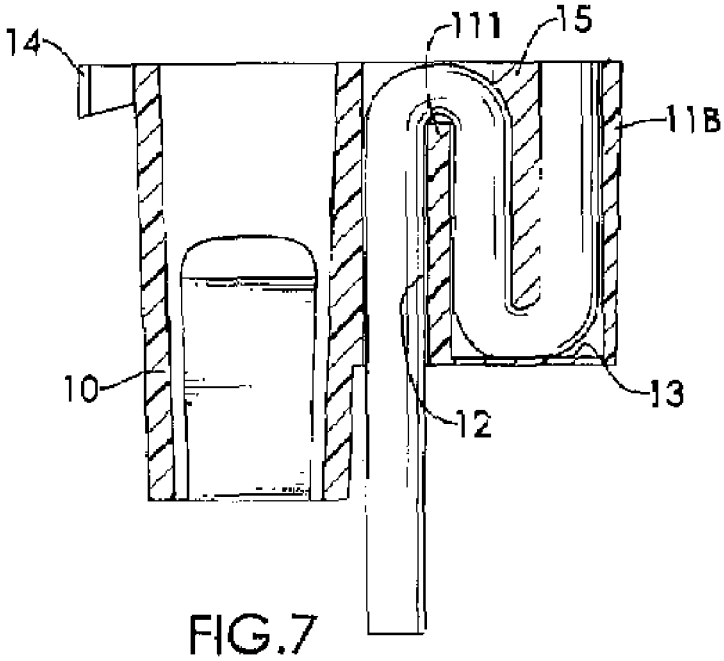
FIG. 7 is a side view in partial section of the attachment for a light string in FIG. 6 when a cord fastens to an attachment.

With reference to FIGS. 6 and 7, a fourth embodiment of an attachment (11B) for a light string in accordance with the present invention is shown. The fastener slot (13) of the body of the attachment (11B) further has an optional fastener peg (15) inserted removably into the fastener slot (13). The fastener peg (15) may have at least two sides and two optional U-shaped recesses (151). The U-shaped recesses (151) are formed, respectively, on opposed edges of the fastener peg (15). The fastener (15) is able to fasten one portion of the cord (20) in the fastener slot (13) of the body of the attachment (11B), and the U-shaped recesses (151) are able to abut sides of the cord (20) when the cord (20) is in a serpentine configuration as shown in FIG. 7.

Figure 8:
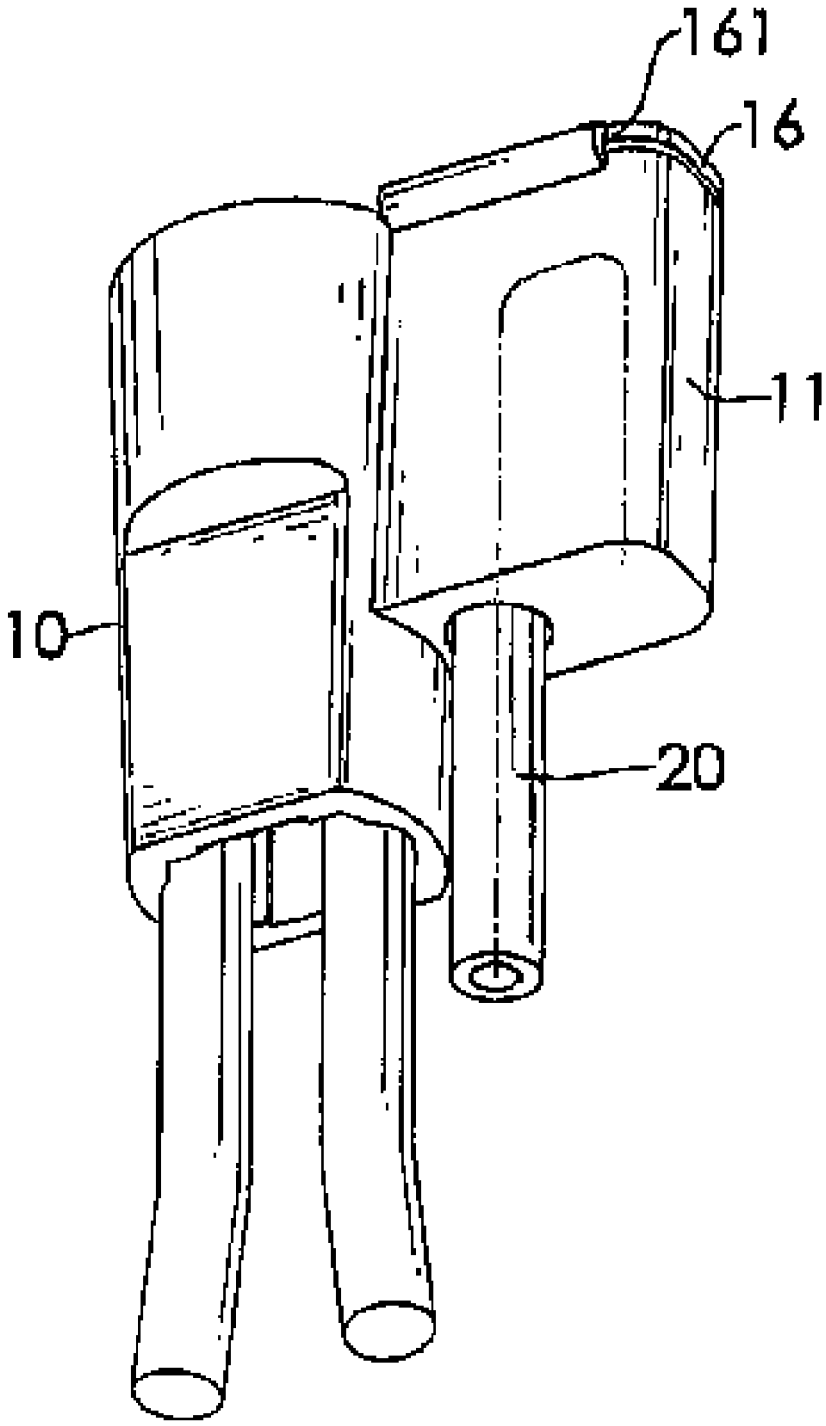
FIG. 8 is a perspective view of a fifth embodiment of the attachment for a light string in accordance with the present invention.
Figure 9:
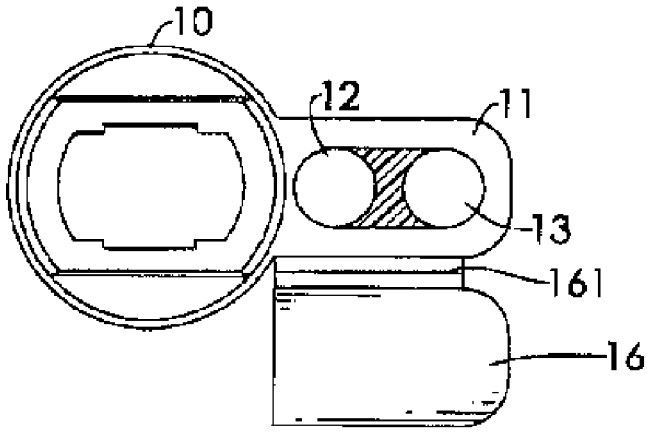
FIG. 9 is a top view of the attachment for a light string in FIG. 8.
Figure 10:
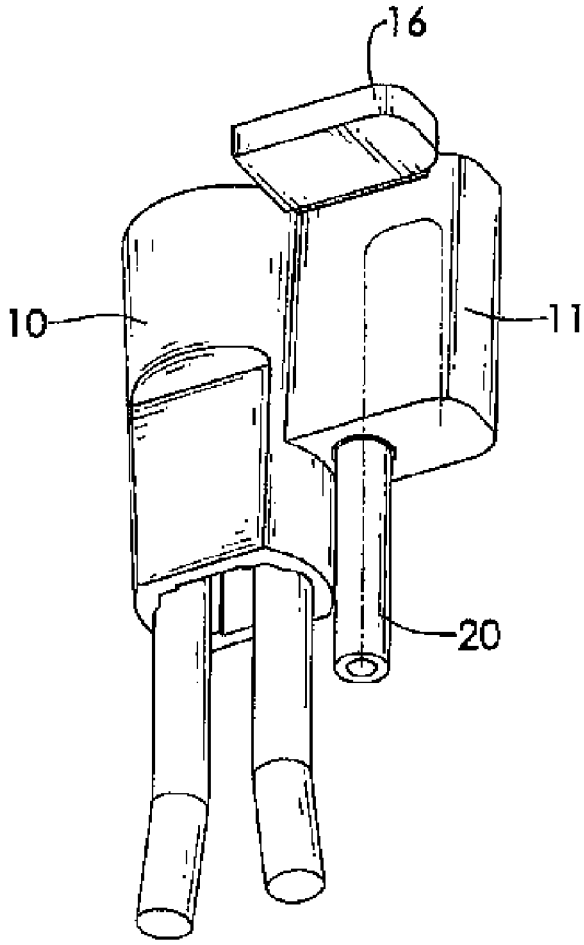
FIG. 10 is a perspective view of the attachment for a light string in FIG. 8 when a cap is not mounted on a top opening of the attachment.

With reference to FIGS. 8, 9 and 10, a fifth embodiment of an attachment for a light string in accordance with the present invention is shown. The body of the attachment (11) further has an optional cap (16). The cap (16) is attached to and integrally connected to the top edge of the body of the attachment (11) and has a joint and a groove (161) formed at the joint between the cap (16) and the body of the attachment (11) to facilitate pivotal movement of the cap (16). When glue or double-sided tape is used to mount the cap (16) to the body of the attachment (11), the cap (16) is able to cover the through hole (12) and the fastener slot (13) so as to prevent the free end of the cord (20) from becoming loose inside the body of the attachment (11).

Figure 11:
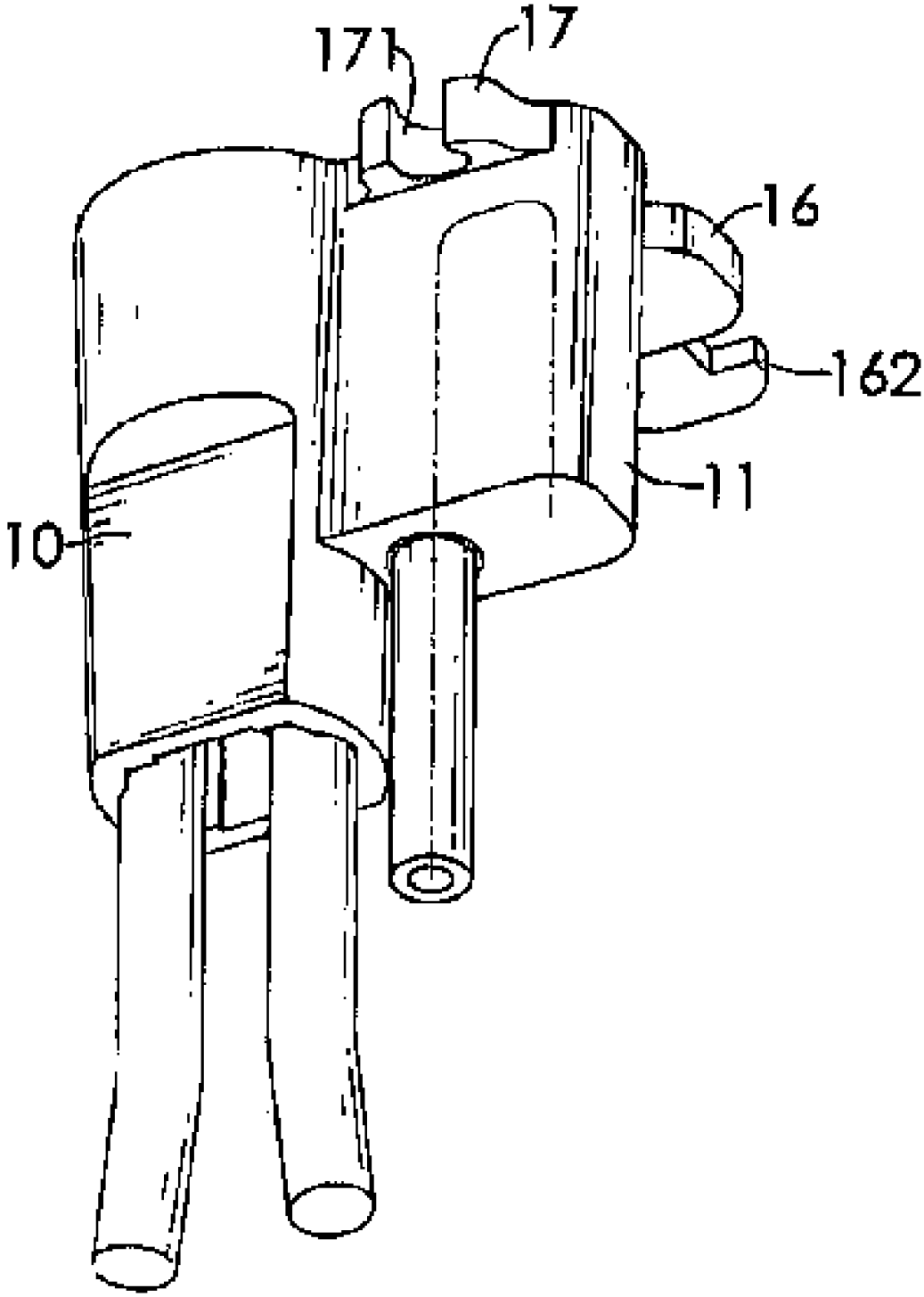
FIG. 11 is a perspective view of a sixth embodiment of the attachment for a light string in accordance with the present invention.
Figure 12:
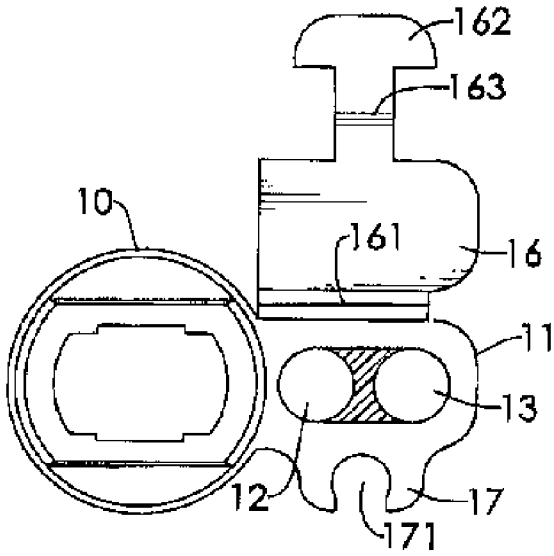
FIG. 12 is a top view of the attachment for a light string in FIG. 11.
Figure 13:
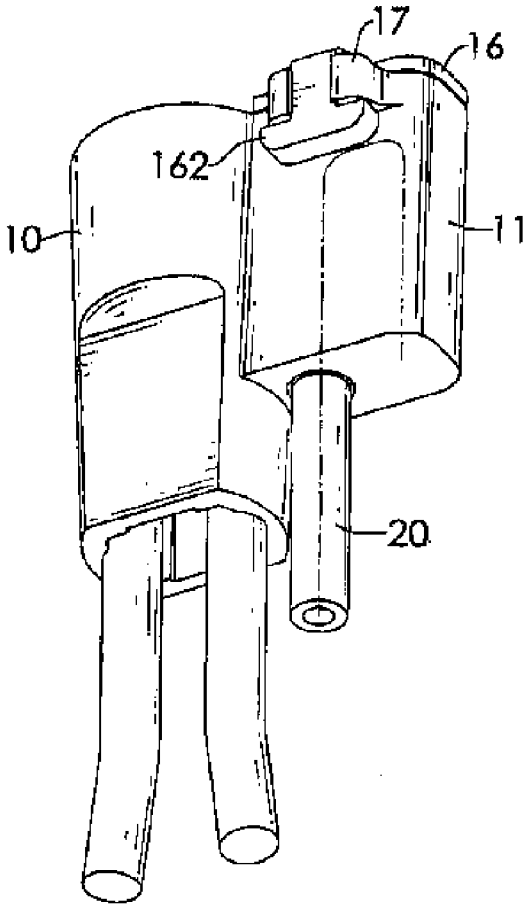
FIG. 13 is a perspective view of the attachment for a light string in FIG. 11 when the cap covers the top opening of the attachment.

With reference to FIGS. 11, 12 and 13, a sixth embodiment of an attachment for a light string in accordance with the present invention is shown, wherein the attachment (11) further has two optional extensions (17) and an optional path (171). The two extensions (17) are oppositely extending out of the top edge and are opposed to the cap (16). The path (171) is formed between two extensions (17).

The cap (16) further has an edge and an optional T-shaped tongue (162). The T-shaped tongue (162) extends out of the edge of the cap (16) and has a bottom section with a notch (163) formed on the bottom section of the T-shaped tongue (162). The notch (163) allows the T-shaped tongue (162) to bend when the T-shaped tongue (162) is to be engaged with the path (171).

Figure 14:
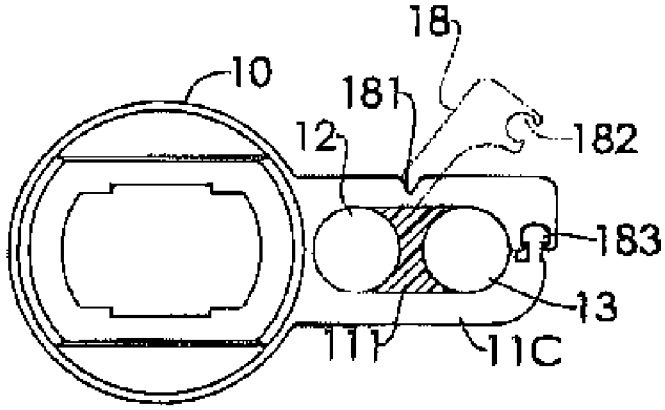
FIG. 14 is a top view of a seventh embodiment of the attachment for a light string in accordance with the present invention.
Figure 15:
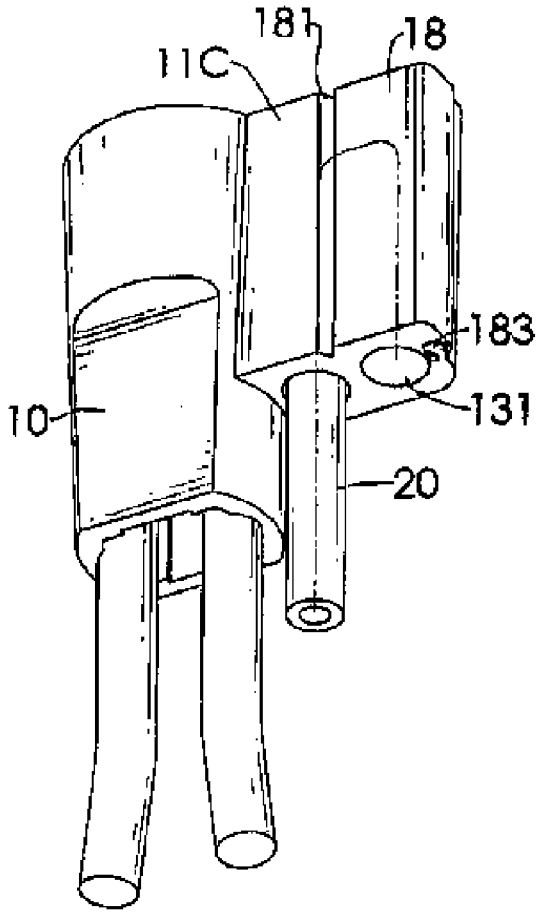
FIG. 15 is a perspective view of the attachment for a light string in FIG. 14.

With reference to FIGS. 14 and 15, a seventh embodiment of an attachment for a light string in accordance with the present invention is shown. The fastener slot (13) has an optional lever (18), a side edge and an optional protrusion (183). The lever (18) is formed at fastener slot (13) of the body of the attachment (11C) and has a side edge, a recess (182) and a notch (181) formed at side of the body of the attachment (11C) whereby the lever (18) can be opened. The recess (182) is formed at the side edge of the lever (18). The protrusion (183) is formed at the side edge of the fastener slot (13) and is received in the recess (182) of the lever (18).

When the end of the cord (20) extends into the fastener slot (13), the lever (18) is able to open to allow the end of cord (20) to easily extend into the fastener slot (13). After the end of the cord (20) is received in the fastener slot (13), the lever (18) is able to close the fastener slot (13) to secure the cord (20).

In conclusion, one portion of the cord (20) can be fastened to one socket (10) and another portion of the cord (20) can be engaged with another socket (10) via the attachment (11, 11A, 11B, 11C), and this is duplicated for all the sockets (10) whereby the cord (20) has a repeated grip on the light string. Thus, two ends of the cord (20) are not able to get loose from a Christmas light string. The Christmas light string will not break when undergoing force, because the cord (20) provides end-to-end security, as well as the cord (20) is secured at regular intervals thus preventing snapping of the cord (20).

The route of the cord (20) varies within the embodiments, but a feature common to all is that at least one hairpin-like bend is formed in the cord (20). Thus, any force tending to stretch the light string is resisted as the bends in the cord (20) act as buffers.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. An attachment adapted to be formed on a side of a socket configured to receive therein a bulb assembly, a cord extending between respective ends of the wires and two wires extending front a bottom of the socket, comprising:

a body having a through hole defined through the attachment for receiving therethrough the cord of the socket;

a fastener slot defined in the attachment for receiving a portion of the cord after the cord has been extended through the through hole; and a block located between the through hole and the fastener slot for separating the through hole and the fastener slot, wherein a cap is attached to the body of the attachment to cover the through hole and the fastener slot so as to prevent the portion of the cord from becoming loose inside the body of the attachment.

2. The attachment as claimed in claim 1, wherein the cap is adapted to extend from a side of the bulb assembly.

3. The attachment claimed in claim 1, wherein the fastener slot of the body of the attachment further has a bottom and a passage defined through the bottom of the fastener slot.

4. The attachment as claimed in claim 1, wherein the cap is pivotally connected to a top edge of the body of the attachment, and a groove is formed at a joint between the cap and the body of the attachment to facilitate pivotal movement of the cap.

5. The attachment for a light string as claimed in claim 4, wherein the body further has at least two extensions oppositely extending out of the top edge and being opposed to the cap and a path formed between the two extensions;

the cap further has an edge and a T-shaped tongue extending out of the edge of the cap and having a notch defined in a bottom section of the T-shaped tongue to allow the T-shaped tongue to be bent so that after the cap is pivoted relative to the body, the T-shaped tongue is able to be selectively received in the path between the extensions.

* * * * *